United States Patent [19]

You

[11] 4,390,182

[45] Jun. 28, 1983

[54] REINFORCED RACKET FRAME AND METHOD OF PRODUCING SAME

[76] Inventor: Chin-San You, No. 3, Lane 1029, Fong-Shih Rd., Weng-Tzu Li, Fong Yuan City, Taiwan

[21] Appl. No.: 271,131

[22] Filed: Jun. 8, 1981

[51] Int. Cl.[3] ..... A63B 49/02

[52] U.S. Cl. ..... 273/73 C; 273/73 F; 273/DIG. 23

[58] Field of Search ..... 273/67 R, 73 R, 73 C, 273/73 F, 73 G, DIG. 7, DIG. 23; 124/23 R; 280/610

[56] References Cited

U.S. PATENT DOCUMENTS

| | | | |
|---|---|---|---|
| 3,827,689 | 8/1974 | Hyde | 273/73 F X |
| 4,070,019 | 1/1978 | Segal et al. | 273/73 F |
| 4,098,505 | 7/1978 | Thompson | 273/73 F |
| 4,201,381 | 5/1980 | Gerbet et al. | 273/73 F |

FOREIGN PATENT DOCUMENTS

| | | | |
|---|---|---|---|
| 1940524 | 2/1971 | Fed. Rep. of Germany | 273/73 F |
| 293123 | 7/1928 | United Kingdom | 273/73 F |
| 627240 | 8/1949 | United Kingdom | 273/73 F |
| 2030455 | 4/1980 | United Kingdom | 273/73 F |

*Primary Examiner*—Anton O. Oechsle
*Attorney, Agent, or Firm*—David M Ostfeld

[57] ABSTRACT

A method of producing a racket frame, in which multiple layers of wooden strips are laminated to form a racket frame. An elongate groove is made at least in a wooden strip of mid layer on the side perpendicular to the string of the racket. The groove includes a shallow elongate central portion and two deeper elongate portions joining longitudinally with the central portion. A reinforcing material is filled in the groove and the mid layer is then plied with the wooden strips of other layers by means of adhesive. The preformed frame is heated and the reinforcing material sets in the groove and form an integral body therewith.

The racket frame comprises, a plurality of elongate wooden strips laminated and fabricated to form a frame; and a reinforcing material being sandwiched in the mid part of the frame. The reinforcing material extends longitudinally along the frame and have a structure in which the cross section is narrow at the central part and broad about two ends.

6 Claims, 6 Drawing Figures

REINFORCED RACKET FRAME AND METHOD OF PRODUCING SAME

This invention relates to a racket frame, particularly, to a method of producing a reinforced wooden racket frame.

In the past, the wooden racket frame are made by laminating oval-shaped multiple layers of wooden strips to form an integral oval-shaped frame. These layers are adhesively bonded to each other. Due to the poor properties of the wood, the frame is easily caused to deform as well as break. The section at the vicinity of the frame especially has a tendency to break due to the higher bending moment to which it is subjected than any other section.

To improve the performance of the wooden racket frame, it has been proposed by several manufacturers to strengthen the frame with reinforcing materials, such as, carbon fiber, glass fiber etc. These have rendered the reinforcement to the frame, and on the other hand, facilitated the design of the racket when the weight or center of gravity of the frame is taken into consideration.

In British Patent Application No. 2030455 published on Apr. 10, 1980, there is disclosed a wooden racket frame reinforced by carbon fiber. The two surfaces parallel to the strings have two separate longitudinal grooves extending from the handle, through the vicinity of the frame, then into the frame and finally back to the handle. A high strength carbon fiber is injected into the grooves and set. It is adhesively bonded to the surface of the wood and forms an integral body therewith (See FIG. 2). In this reinforced structure, as the two elongate reinforcing members are discrete inside the frame, there is no other bonding except the bonding between the carbon fiber and wood. If this bonding breaks after a period of use, the carbon fiber will drop off and therefore the reinforcement will be damaged. In the bending moment test, when such structure of reinforced racket frame is subjected to a load of 80 pounds to 100 pounds, it is observed that the carbon fiber gets away from the groove.

This invention has overcome the above drawbacks. The reinforcing material is being sandwiched between two wooden layers. The structure can possess not only the bonding between the wood and reinforcing material but also has self-bonding within the reinforcing layer so that it will not drop off therefrom. Moreover, this structure has been made into a form having an I-shaped cross-section or the like, and therefore will improve the strength of the frame relative to the bending moment. As the string passes through the reinforced layer, it will enable the frame to endure more abrasion relative to the strings.

SUMMARY OF THE INVENTION

According to this invention, a method of producing a racket frame is disclosed, in which multiple layers of wooden strips are laminated to form a racket frame, comprising the steps of: making an elongate groove at least in a wooden strip of mid layer on the side perpendicular to the string of the racket, the groove including a shallow elongate central portion and two deeper elongate portions joining longitudinally with the central portion; filling the groove with a reinforcing material; applying an adhesive on the surfaces required to ply with wooden strips of other layers and arranging them in lamination; heating the preformed frame of laminated wooden strips to make the reinforcing material set in the groove and form an integral body therewith; and trimming the free side parts of the wood facing the reinforcing material for exposure.

An object of the invention is to provide a method of producing a reinforced wooden racket frame having more strengthened reinforcing structure.

Another object of the invention is to enhance the bonding of the reinforcing member in a wooden racket frame.

Further object of the invention is to provide a novel and improved reinforced wooden racket frame.

These and other objects, advantages and features of the present invention will become apparent from the following detailed description of the preferred embodiments with reference to accompanying drawings, wherein:

DETAILED DESCRIPTION OF THE INVENTION

Figure 1:
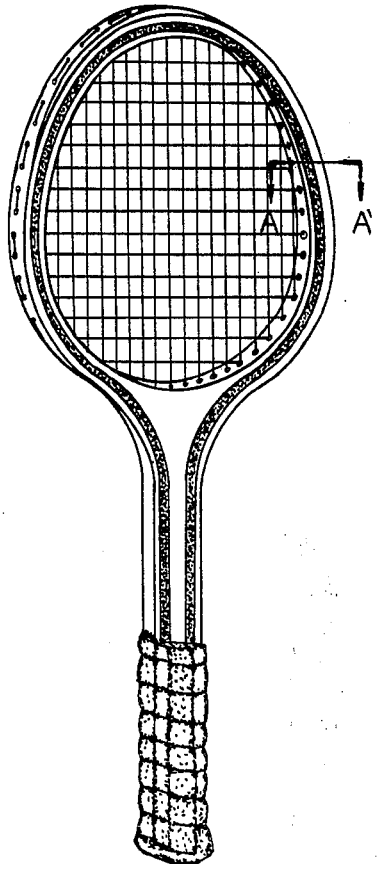
FIG. 1 is a perspective view of a reinforced racket.
Figure 2:
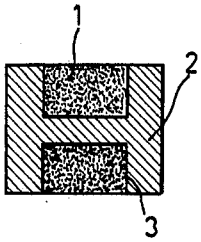
FIG.2 PRIOR ART
FIG. 2 is a sectional view of a prior art taken along the plane A—A' of FIG. 1.
Figure 3:
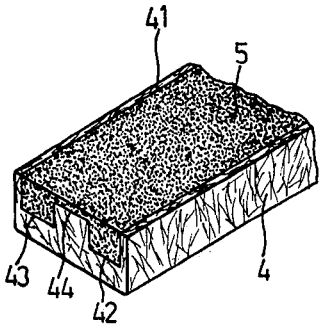
FIG. 3 is an enlarged perspective view of a midlayer in part according to the present invention illustrating a mid layer being filled with a reinforcing material.
Figure 4:
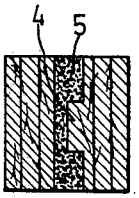
FIG. 4 is a sectional view of a preferred embodiment taken along the plane A—A' of FIG. 1.

As shown in FIGS. 1 and 3, a preferred embodiment of the invention comprises a frame of laminated layers of wood extending from the handle, through the vicinity of the frame, then into the frame and finally back to the handle. The mid layer 4 has two longitudinal grooves 43 and 42 on the surface perpendicular to the string plane of the racket. Between these grooves 43 and 42 is a shallow groove 44 joining longitudinally therewith. A reinforcing material 5 is filled into the grooves 42, 43, 44 and then the layer is plied with other layers by applying adhesive to the abutting surfaces (see FIG. 4). This preformed racket frame is heated up to the temperature 70° C.–80° C., and after 3–4 hours, the reinforcing material 5 sets in the groove 42, 43, 44 and form an integral body with the wooden layer 4. The free side parts of the wood facing the groove 42 and 43 is trimmed during the trimming work and then the whole frame is coated with a transparent surface coating.

Figure 5:
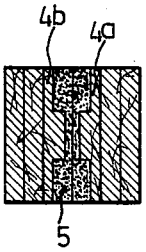
FIG. 5 is a sectional view of another preferred embodiment taken along the plane A—A' of FIG. 1.

In another preferred embodiment, the reforcing material 5 sets in the grooves of two mid wooden layer **4*b* and 4*a* (see FIG. 5**). The integral body of the frame has a reinforcing structure with the appearance of an I-shape in cross section.

Figure 6:
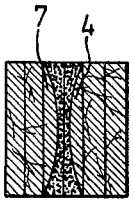
FIG. 6 is a sectional view of further preferred embodiment taken along the plane A—A' of FIG. 1.

In FIG. 6, a further preferred embodiment is shown having a reinforcing structure resembling a concave lens shape in cross-section. The embodiment is made in a similar manner to the cases of the preferred embodiments discussed above, except that the mid layers 4 and 7 form a groove in the shape of a concave lens.

With the invention thus explained, it is apparent that any improvements and modifications can be made without departing from the spirit of the present invention. It is intended that the scope of the present invention is defined merely by the appending claims.

What I claim is:

1. A method for producing a racket frame for holding strings using multiple layers of wooden strips laminated together, comprising the steps of:

forming an elongate groove in at least one wooden strip of the mid layer of the multiple layers on the side of the wooden strip, said groove extending perpendicularly to the string plane, the groove including a shallow elongate central portion and two deeper elongate portions joining longitudinally with the central portion;

filling the groove with a reinforcing material for improving the strength of the frame shape relative to bending moment;

applying an adhesive on the surfaces required to ply with the wooden strips of the other layer and arranging them in lamination frame shape;

heating the preformed frame shape of laminated wooden strips to set the reinforcing material in the groove and form an integral body therewith.

2. The method of claim 1, wherein the outer extremities of the groove are closed by outer facings of the wooden mid layer, and the method further comprising the steps of trimming said facings to expose the reinforcing material.

3. A racket frame, comprising:

a plurality of elongate wooden strips laminated and fabricated to form a frame shape;

a groove formed in the mid part of said strips and extending longitudinally therethrough perpendicularly to the string plane of the racket, the groove having a cross section narrow at the center and wider at the ends;

a reinforcing material in said groove extending longitudinally along the full length of said groove and substantially filling all of said groove, said reinforcing material comprising means for improving the strength of said frame shape relative to bending moment, whereby the shape of the groove bonds the reinforcing material to the wood.

4. The racket frame as claimed in claim 3, wherein the cross-section of said reinforcing material is I-shaped.

5. The racket frame as claimed in claim 3, wherein the cross-section of said reinforcing material is concave lens-shaped.

6. The racket frame of any one of claims 1–5 wherein said reinforcing material comprises a high strength carbon fiber.

* * * * *